US006618976B1

(12) United States Patent
Swan

(10) Patent No.: US 6,618,976 B1
(45) Date of Patent: Sep. 16, 2003

(54) DROP-IN LASER

(76) Inventor: Richard E. Swan, 171 West St., E. Bridgewater, MA (US) 02333

( * ) Notice: Subject to any disclaimer, the term of this patent is extended or adjusted under 35 U.S.C. 154(b) by 0 days.

(21) Appl. No.: 10/314,801

(22) Filed: Dec. 9, 2002

Related U.S. Application Data

(63) Continuation-in-part of application No. 10/007,590, filed on Dec. 10, 2001, now Pat. No. 6,490,822.

(51) Int. Cl.[7] ..... F41A 15/00; F41C 23/00

(52) U.S. Cl. ..... 42/114; 42/115; 42/71.01; 42/75.01; 33/233; 33/241

(58) Field of Search ..... 42/114, 115, 71.01, 42/75.01; 33/233, 235, 241

(56) References Cited

U.S. PATENT DOCUMENTS 3,939,589 A * 2/1976 Tellie ..... 42/71.01
5,010,676 A * 4/1991 Kennedy ..... 42/71.01
5,533,292 A * 7/1996 Swan ..... 42/123
5,555,662 A * 9/1996 Teetzel ..... 42/115
5,808,226 A * 9/1998 Allen et al. ..... 89/1.11
6,345,464 B1 * 2/2002 Kim et al. ..... 42/114
6,453,594 B1 * 9/2002 Griffin ..... 42/105
6,490,822 B1 * 12/2002 Swan ..... 42/71.01
6,499,245 B1 * 12/2002 Swan ..... 42/71.01

* cited by examiner

*Primary Examiner*—J. Woodrow Eldred
(74) *Attorney, Agent, or Firm*—John P. McGonagle

(57) ABSTRACT

A laser module adapted to being joined to a modular sleeve upper handguard piece top longitudinal gap. The laser module has two, parallel elongated submodules positioned so that an elongated, generally rectangular space is formed between the submodules. The laser module elongated space fits onto the longitudinal gap and the submodules fit along the upper handguard sides in the shallow upper channels. An upper handguard interface element is attached centrally over the laser module top. Each submodule has means for azimuth and height adjustments.

5 Claims, 5 Drawing Sheets

DROP-IN LASER

RELATED U.S. APPLICATION DATA

This application is a Continuation-In-Part of patent application Ser. No. 10/007,590, filed Dec. 10, 2001, and now U.S. Pat. No. 6,490,822, issued on Dec. 10, 2002.

BACKGROUND OF THE INVENTION

This invention relates to firearms, and more particularly to a laser device adapted to being added to a firearm.

As the field of combat and commercial weaponry expands, numerous add-on enhancements have become available for attachment to standard firearms thereby significantly upgrading the capability of the firearm. Various methods and means have been developed for interfacing the various add-on enhancements to firearms. Applicant's U.S. Pat. No. 4,845,871, "Attachment Device, issued on Jul. 11, 1989, and incorporated herein by reference, disclosed a quickly detachable interface means for modular enhancements. Applicant's U.S. Pat. No. 5,142,806, "Universal Receiver Sleeve", issued on Sep. 1, 1992, and incorporated herein by reference, disclosed a universal receiver sleeve having an upper interface portion with standard, universal dimensions regardless of the firearm and having a lower interface portion specific to a particular firearm. Applicant's U.S. Pat. No. 5,343,650, "Extended Rigid Frame Receiver Sleeve", issued on Sep. 6, 1994, and incorporated herein by reference, disclosed an extended rigid interface frame with upper and lower rails joined to a firearm receiver and extending forward about the firearm's barrel to a head assembly replacing the firearm's normal front sight. The invention disclosed permitted the barrel of the rifle to be free floating.

With the increasing development and refinement of laser technology, it has become highly desirable to integrate laser technology capabilities onto and into firearms. The problem with integrating laser technology to firearms is the inherent conflict between a gun barrel's physical functioning and the rigid environment required for laser operations. For maximum results, a gun barrel should be physically isolated, i.e., "floating". It is preferred that nothing be attached to the gun barrel, thereby isolating the barrel physically and eliminating bending and "droop" along the barrel's longitudinal axis. The ideal arrangement for lasers and ancillary optics and electronics is one of complete isolation from the gun barrel. The temperature of a gun barrel in use can rise to 900° F. This type of heat, as well as the physical shock on the gun barrel from firing, will quickly destroy lasers and ancillary optics and electronics. The heat generated by the gun barrel transfers directly to any devices touching it thereby directly transferring enough heat to burn hands and destroy attached electrical devices. Further compounding this problem is the requirement that gun barrels be extra heavy to support the added weight attached by means of the collars. This in turn means more cantilevered stress on the barrel where it is joined with the M-16's aluminum receiver. The combination of heat and barrel weight tend to pull the barrel chamber out of alignment with the bolt lead, thereby causing bolt lug and extractor failure. Applicant addressed these problems in his application, "Modular Sleeve", application Ser. No. 10/007, 590, filed on Dec, 10, 2001, and now U.S. Pat. No. 6,490, 822, Issued on Dec. 10, 2001, incorporated herein by reference.

Applicant's Modular Sleeve provides a modular receiver sleeving system. To attain this, the Modular Sleeve extended the Swan universal receiver sleeve forward above the firearm barrel to a position just short of the firearm front sight. The underside of the rear portion of the sleeve was fixedly attached to the receiver top. The underside of the forward portion of the sleeve had an upper handguard piece attached. A bottom handguard piece was fitted about the bottom of the gun barrel and attached to the upper handguard piece via a unique channel and track system. The handguard pieces were not physically connected in any way to the gun barrel. The sleeve was self supported by the connection of the rear portion underside to the receiver top. Laser, electronics and optics modules could then optionally be attached to the sleeve top side or to the upper handguard piece via special male and female dovetail track devices. The barrel of the rifle was essentially free floating. This permits greater shooting accuracy and protects sensitive electrical components integrated into and onto the firearm via the invention. Lighter weight barrels can be utilized as they are no longer deflected by outside pressure and direct transfer of heat to the hand is also eliminated.

SUMMARY OF THE INVENTION

The present invention is a laser module adapted specifically for Applicant's Modular Sleeve and is adapted to be "dropped into" the Modular Sleeve. The invention laser module has two, parallel elongated modules which are fitted along side of the gun barrel, but shielded by the Modular Sleeve. By placing the laser module along side of the gun barrel, various optic and energy directed devices may be placed on the top of the Modular Sleeve in a conventional arrangement without interference with and from the laser module. Positioning the laser elongated modules on each side of the barrel also permits the laser to be closer to the center line of the barrel bore.

These together with other objects of the invention, along with various features of novelty which characterize the invention, are pointed out with particularity in the claims annexed hereto and forming a part of this disclosure. For a better understanding of the invention, its operating advantages and the specific objects attained by its uses, reference should be had to the accompanying drawings and descriptive matter in which there is illustrated a preferred embodiment of the invention.

DETAILED DESCRIPTION OF THE INVENTION

Figure 1:
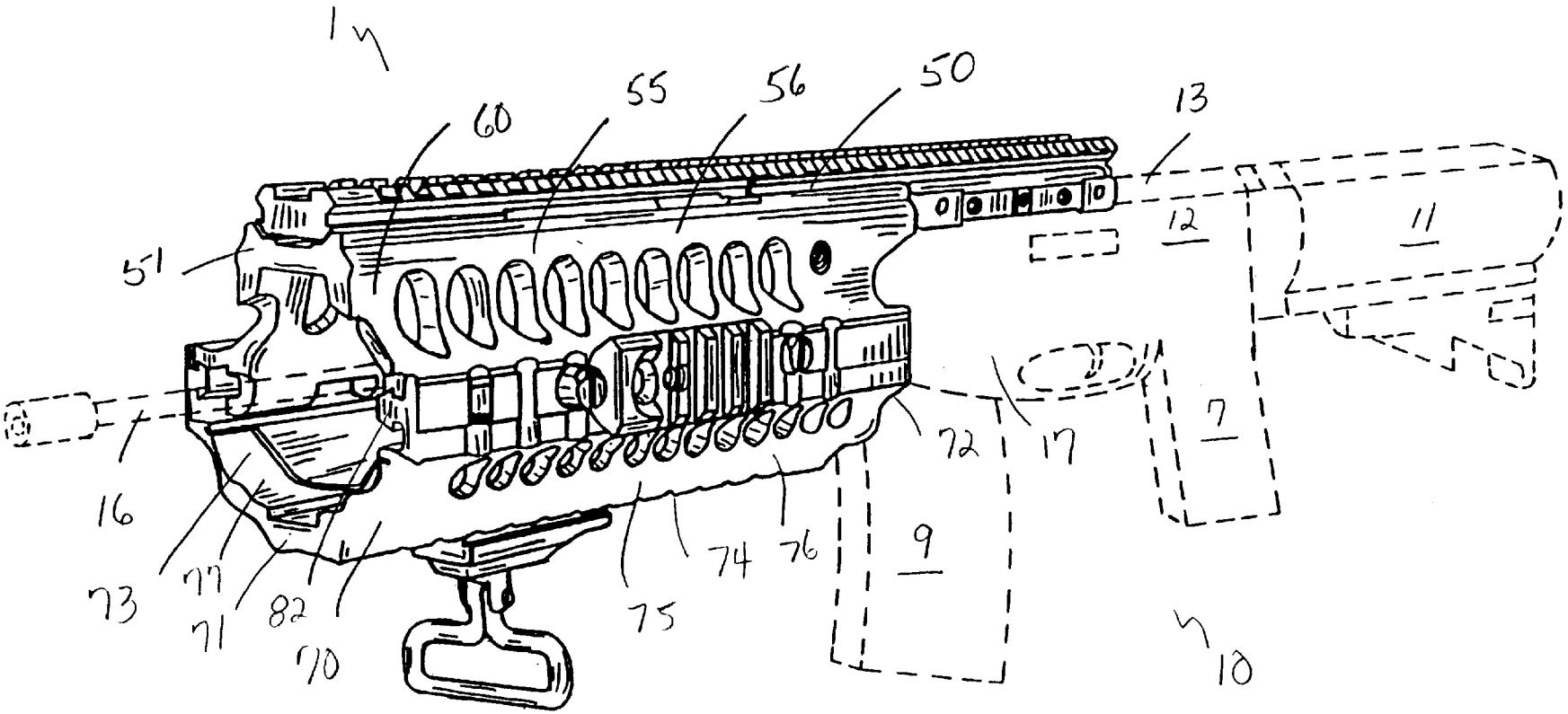
FIG. 1 is a front perspective view of a modular sleeve mounted on a firearm.
Figure 2:
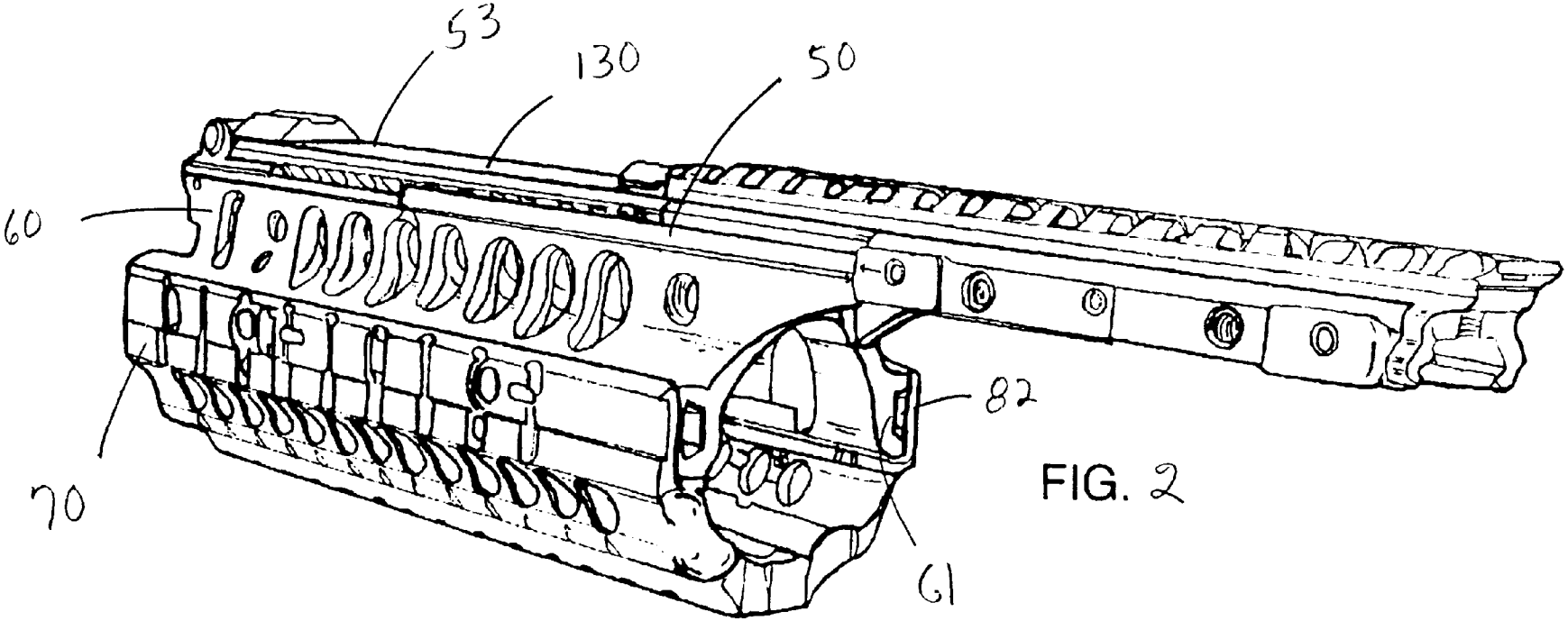
FIG. 2 is a rear perspective view of the modular sleeve.
Figure 3:
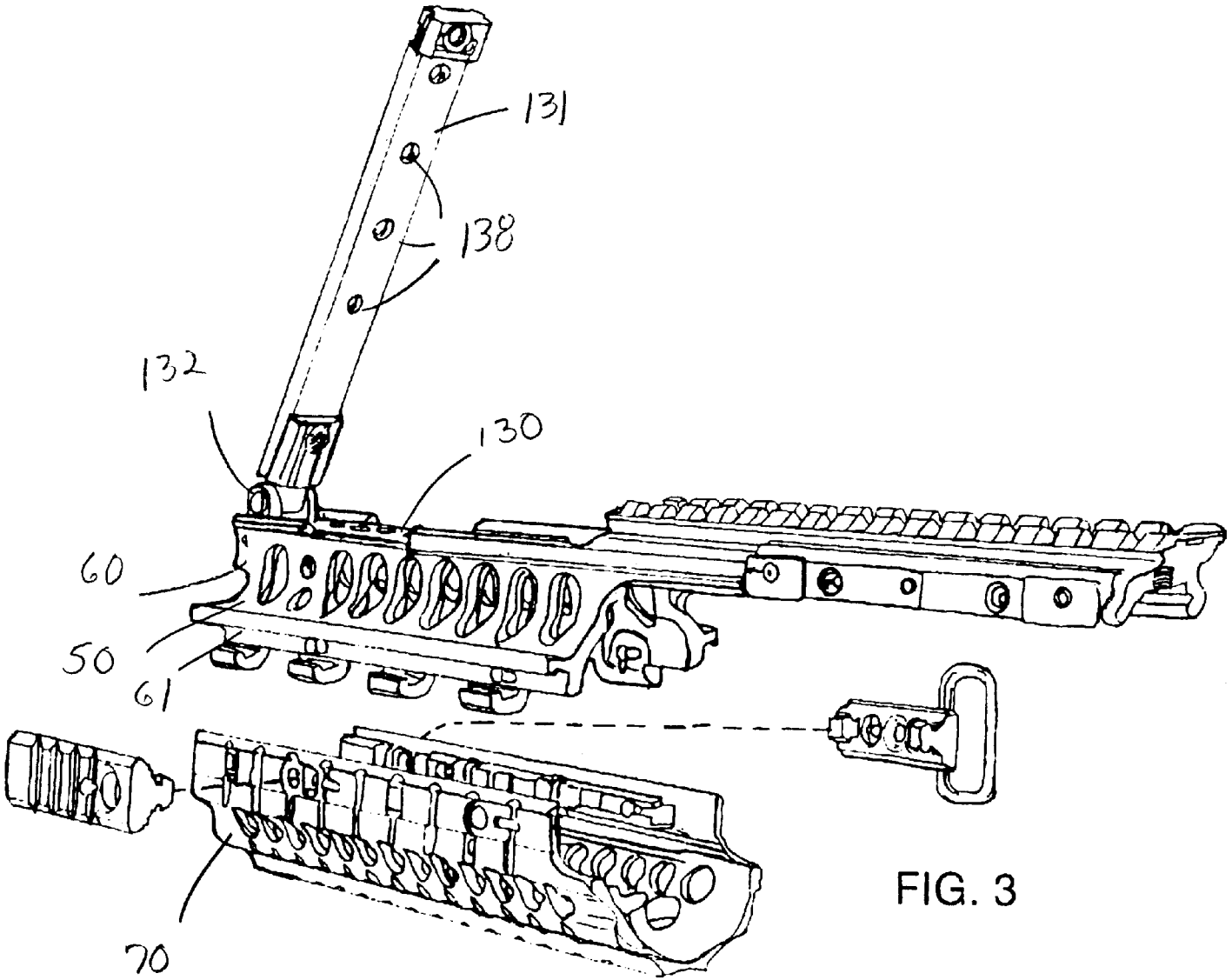
FIG. 3 is an exploded view of the modular sleeve.
Figure 4:
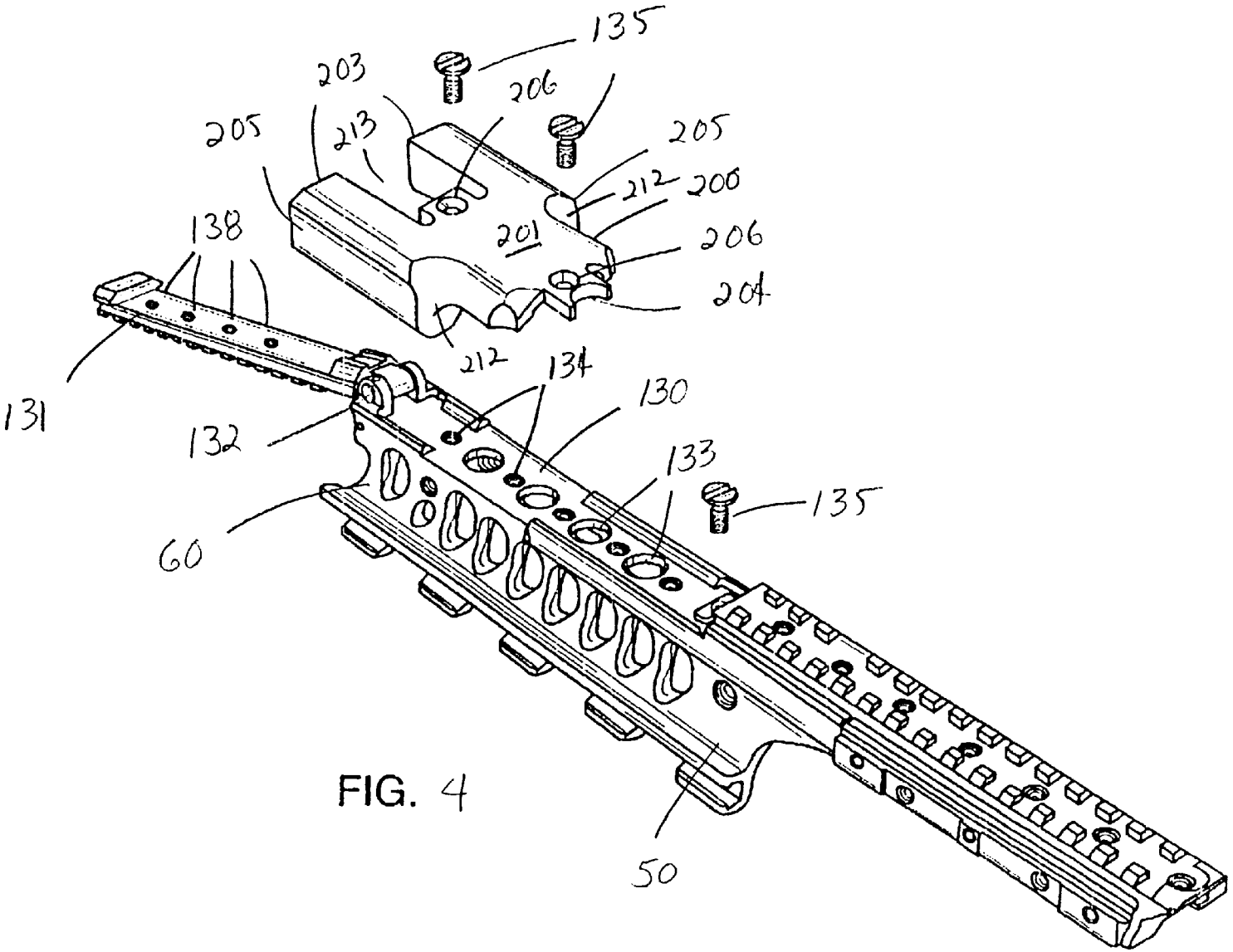
FIG. 4 is a top perspective, exploded view of the upper handguard piece and laser module.
Figure 5:
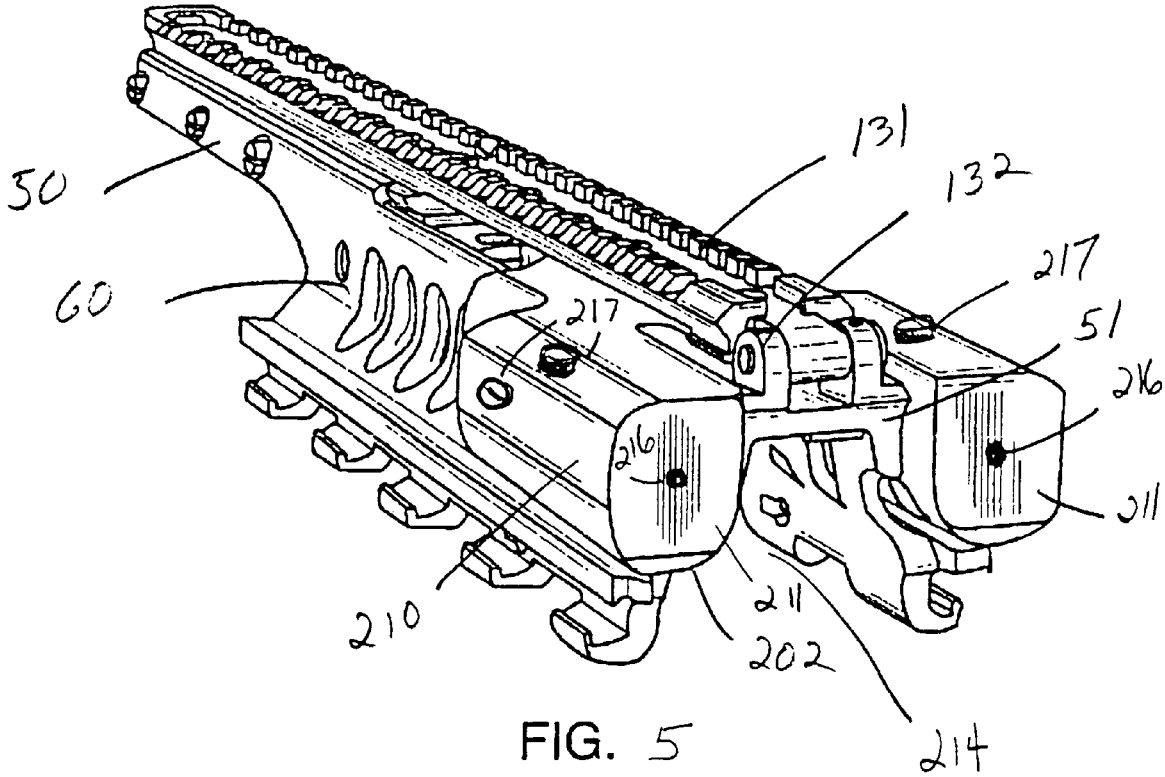
FIG. 5 is a front perspective view of the upper handguard piece with laser module installed.

Referring to the drawings in detail wherein like elements are indicated by like numerals, there is shown in FIG. 1 a front perspective view of a modular sleeve 1 mounted on an outline of a conventional firearm 10, having a stock 11, upper receiver 12 with flat top 13, lower receiver 17, barrel 16, pistol grip 7, and magazine 9. The barrel 16 is joined to the upper receiver 12. The barrel 16 defines the forward portion of the firearm 10 and the stock 11 defines the rearward portion of the firearm 10. The longitudinal axis of the firearm 10 runs from stock 11 through receiver 12, 17 to barrel 16. The stock 11 is joined to the rear portion 15 of the upper receiver 12. The modular sleeve 1 about the firearm barrel 16 replaces the firearm's conventional handguards with a handguard assembly integrated into the modular sleeve 1.

The modular sleeve 1 is comprised of an upper handguard piece 50 joined to a bottom handguard piece 70. The upper handguard piece 50 has a front 51, rear 52, top 53, opposing sides 55 and outer surface 56 , said front 51 and rear 52 defining an upper handguard piece longitudinal axis. Each of the upper handguard side outer surfaces 56 have two longitudinal channels formed therein, i.e., a large and shallow upper channel 60 and a bottom interface channel 61. The upper channel 60 permits ancillary equipment to be placed closer to the center line of the barrel bore. The bottom interface channel 61 is positioned near to the upper handguard piece bottom 54.

The bottom handguard piece 70 has a front 71, rear 72, open top 73, bottom 74, opposing sides 75, outer side surfaces 76 and inner side surfaces 77, said bottom top 74 and sides 75 defining an interior 78. The front 71 and rear 72 define the bottom handguard piece's longitudinal axis.

The bottom hand guard inner side surfaces 77 each have a longitudinal T-shaped protrusion 82 position near to the top 73, each protrusion being a mirror of the other. The bottom handguard piece 70 is adapted to being joined to the upper handguard piece 50 by sliding the bottom handguard longitudinal T-shaped protrusion 82 into the upper handguard bottom interface channel 61.

The upper handguard piece top 53 has a longitudinal gap 130 formed therein. A hinging element 132 is fixed to the upper handguard piece top 53 at the front 51 and is adapted to pivotally join an interface element 131 which may have different attachment configurations on each surface. The interface element 131 has several fastener holes 138 formed centrally therein, each said fastener hole 134 being adapted to receive a threaded fastener 135. The handguard piece top 53 has several heat venting apertures 133 formed through the longitudinal gap 130. In addition to the venting apertures 133 there are several fastener holes 134 formed therein, each said fastener hole 134 being adapted to receive a threaded fastener 135.

The present invention is a laser module 200 adapted to being "dropped into" the upper handguard piece top longitudinal gap 130. The laser module 200 has a flat top 201, bottom 202, front 203, rear 204, and two opposing sides 205, said front 203 and rear 204 defining a laser module longitudinal axis. The longitudinal axis of the laser module 200 is parallel to and partly coincident with the longitudinal axis of the upper handguard piece 50. The laser module 200 is further comprised of two, parallel elongated submodules 210, each submodule 210 having a front 211 and a rear 212, said front 211 and rear 212 defining a submodule longitudinal axis, said submodule longitudinal axes being parallel to and partly coincident with the longitudinal axis of the laser module 200. The submodule fronts 211 would each have an aperture 216 permitting directed output from the submodules 210. The submodules 210 are positioned so that an elongated, generally rectangular space 213 is formed between the submodules 210. The elongated space 213 has an open bottom 214, a top formed by the laser module flat top 201 and two sides formed by the submodules 210. The elongated space 213 has a side-to-side width slightly greater than an upper handguard top width. The laser module top 201 has two fastener apertures 206 formed centrally therein.

The laser module 200 is adapted to being installed in the upper handguard top longitudinal gap 130. The laser module elongated space 213 fits onto the longitudinal gap 130. The submodules 210 fit along the upper handguard sides 55 in the shallow upper channels 60. The submodule fronts 211 are approximately aligned with the upper handguard front 51. The upper handguard interface element 131 is closed centrally over the laser module top 201 and several threaded fasteners 135 are inserted through the interface element fastener holes 138 into the longitudinal gap fastener holes 134, two such fasteners 135 being inserted through the laser module fastener apertures 206 into the longitudinal gap fastener holes 134.

Each submodule 210 will typically have a different purpose. For example, one submodule 210 may provide an aiming beam while the other submodule 210 provides an infrared illuminator. Regardless of the purpose, each submodule 210 would typically have means 207 for azimuth and height adjustments whereby the output from each submodule could be zeroed with the gun barrel 16.

It is understood that the above-described embodiment is merely illustrative of the application. Other embodiments may be readily devised by those skilled in the art which will embody the principles of the invention and fall within the spirit and scope thereof.

I claim:

1. In conjunction with a modular sleeve mounted on a conventional firearm having a stock, upper receiver with flat top, lower receiver, barrel, pistol grip, and magazine, said barrel being joined to the upper receiver, said barrel defining a forward portion of the firearm, said stock being joined to a rear portion of the upper receiver, said stock defining a rearward portion of the firearm, said firearm having a longitudinal axis running from said stock through said upper receiver to said barrel, wherein said modular sleeve is comprised of an upper handguard piece joined to a bottom handguard piece, said upper handguard piece having a front, rear, top, opposing sides and outer surface, said front and rear defining an upper handguard piece longitudinal axis, each of the upper handguard side outer surfaces having two longitudinal channels formed therein, a large and shallow upper channel and a bottom interface channel, said upper handguard piece top having a longitudinal gap formed therein, wherein a hinging element is fixed to the upper handguard piece top at the front and is adapted to pivotally join an interface element, said interface element having a plurality of fastener holes formed centrally therein, each said fastener hole being adapted to receive a threaded fastener, said handguard piece top having a plurality of heat venting apertures formed through the longitudinal gap, said handguard top piece having a plurality of fastener holes formed therein, each said fastener hole being adapted to receive a threaded fastener, a laser module adapted to being placed into the upper handguard piece top longitudinal gap, said laser module having a flat top, bottom, front, rear, and two opposing sides, said front and rear defining a laser module longitudinal axis, said laser module longitudinal axis being parallel to and partly coincident with the longitudinal axis of the upper handguard piece, comprising:

two, parallel elongated submodules, each submodule having a front and a rear, said front and rear defining a submodule longitudinal axis, said submodule longitudinal axes being parallel to and partly coincident with the longitudinal axis of the laser module, each said submodule front having an aperture permitting directed output from the submodule, each said submodule being positioned so that an elongated, generally rectangular space is formed between the submodules;

said elongated rectangular space having an open bottom, a top formed by the laser module flat top and two sides formed by the said submodules, said elongated rectangular space having a side-to-side width slightly greater than an upper handguard top width; and a plurality of fastener apertures formed centrally in said laser module top.

2. A laser module as recited in claim 1, wherein:

said laser module is adapted to being installed in the upper handguard top longitudinal gap;

wherein the laser module elongated rectangular space fits onto the longitudinal gap;

wherein the submodules fit along the upper handguard sides in the shallow upper channels; and wherein the submodule fronts are approximately aligned with the upper handguard front.

3. A laser module as recited in claim 2, wherein:

the upper handguard interface element is adapted to close centrally over the laser module top.

4. A laser module as recited in claim 3, wherein:

a plurality of threaded fasteners are adapted to being inserted through the interface element fastener holes into the longitudinal gap fastener holes, a plurality of such fasteners being inserted through the laser module fastener apertures into the longitudinal gap fastener holes.

5. A laser module as recited in claim 4, further comprising:

means for submodule azimuth and height adjustments.

* * * * *